US007612727B2

(12) United States Patent
Schwenke

(10) Patent No.: US 7,612,727 B2
(45) Date of Patent: Nov. 3, 2009

(54) ANTENNA FOR PLASTIC WINDOW PANEL

(75) Inventor: Robert Schwenke, Fowlerville, MI (US)

(73) Assignee: Exatec, LLC, Wixon, MI (US)

( * ) Notice: Subject to any disclaimer, the term of this patent is extended or adjusted under 35 U.S.C. 154(b) by 568 days.

(21) Appl. No.: 11/321,235

(22) Filed: Dec. 29, 2005

(65) Prior Publication Data

US 2007/0152896 A1 Jul. 5, 2007

(51) Int. Cl.
*H01Q 1/32* (2006.01)

(52) U.S. Cl. ..... 343/713; 343/872

(58) Field of Classification Search ..... 343/711–713, 343/872, 873, 700 MS
See application file for complete search history.

(56) References Cited

U.S. PATENT DOCUMENTS

| | | | | |
|---|---|---|---|---|
| 4,485,387 | A | 11/1984 | Drumheller | |
| 4,937,585 | A * | 6/1990 | Shoemaker | 343/700 MS |
| 5,255,002 | A * | 10/1993 | Day | 343/713 |
| 6,103,998 | A | 8/2000 | Kuno et al. | |
| 6,369,773 | B2 * | 4/2002 | Kashiwagi et al. | 343/873 |
| 6,797,384 | B2 | 9/2004 | Gasworth et al. | |
| 6,809,692 | B2 | 10/2004 | Puente Baliarda et al. | |
| 2003/0034926 | A1 | 2/2003 | Veerasamy | |
| 2003/0058178 | A1 * | 3/2003 | Von Alpen et al. | 343/713 |
| 2004/0157052 | A1 | 8/2004 | Benyahia et al. | |

FOREIGN PATENT DOCUMENTS

| | | | |
|---|---|---|---|
| EP | 0 849 823 | A1 | 6/1998 |
| EP | 1 313 166 | A1 | 5/2003 |
| WO | WO 99/66588 | | 12/1999 |
| WO | WO 2005/117494 | A1 | 5/2005 |
| WO | WO 2006/121484 | A2 | 11/2006 |

OTHER PUBLICATIONS

Bayer R&D Investor Day 2005, Science For a Better Life. Dec. 8, 2005, London.

SAE Technical Paper Series No. 880087, Alan W. Mill, et al., "Measurement of Vehicle Antenna Patterns and Performance"—International Congress and Expoisiton, Detroit, Michigan, Feb. 29-Mar. 4, 1988.

SAE Technical Paper Series No. 940264, H.K. Lindenmeier, et al., "Integrated Backlite Antenna System for AM/FM and TV Broadcast Reception and for Mobile Telephone"—International Congress & Exposition, Detroit, Michigan, Feb. 18-Mar. 3, 1994.

SAE Technical Paper Series No. 1999-01-0258, Andrew Adrian, "Concealed AM/FM Antenna and Reception Subsystem for the Quarter Glass of SUV's and Mini-Vans"—International Congress & Exposition, Detroit, Michigan, Mar. 1-4, 1999.

Werner Hödlmayr, "Fractal Antennas", Introduction to fractal technology and presentation of a fractal antenna adaptable to any transmitting frequency —The "Fractent", antenneX Online Issue No. 81—Jan. 2004, pp. 1-18.

* cited by examiner

*Primary Examiner*—Tan Ho
(74) *Attorney, Agent, or Firm*—Brinks Hofer Gilson & Lione

(57) ABSTRACT

A window assembly capable of receiving wireless signals is described. The window assembly includes a plastic substrate having a first side and a second side. A coating is coupled to the first side of the plastic substrate. An antenna is located adjacent to the first side of the plastic substrate. The antenna may be located between the first side of the plastic substrate and the coating or may be embedded within the coating.

23 Claims, 4 Drawing Sheets

ANTENNA FOR PLASTIC WINDOW PANEL

BACKGROUND

1. Field of the Invention:

The present invention generally relates to automobile antennas.

2. Description of the Known Technology:

Plastic materials, such as polycarbonate (PC) and polymethyl methyacrylate (PMMA), are currently being used in the manufacturing of numerous automotive parts and components, such as B-pillars, headlamps, and sunroofs. Automotive window modules represent an emerging application for these plastic materials because of various advantages in the areas of styling/design, weight savings, and safety/security. More specifically, plastic materials offer the automotive manufacturer the ability to reduce the complexity of the window assembly through the integration of functional components into the molded plastic module as well as to distinguish their vehicle from a competitor's vehicle by increasing overall design and shape complexity. The use of light weight plastic window modules may facilitate both a lower center of gravity for the vehicle and improved fuel economy. Additionally, plastic window modules increase the overall safety of a vehicle by enhancing the retention of occupants during a rollover accident.

Until recently, telecommunication systems present in an automobile were limited to a few systems, mainly the analog radio reception (AM/FM bands). The most common solution for these systems is a typical whip antenna mounted on the car roof or body. The current tendency in the automotive sector is to reduce the aesthetic and aerodynamic impact due to these antennas by lowering their profiles and embedding them in the vehicle structure. Furthermore, a major integration of several telecommunication services into a single antenna would help to reduce the manufacturing costs or the damages due to vandalism and car wash equipments.

Therefore, it is desired to provide an antenna system that features minimal aesthetic or aerodynamic impact, protection from vandalism and is cost effective to manufacture.

BRIEF SUMMARY

In overcoming the drawbacks and limitations of the known art, the present invention provides an automobile having a window assembly with an antenna embedded within the window assembly. The window assembly includes a plastic substrate having a top side and a bottom side. The plastic substrate may be made of a thermoplastic resin including, but not limited to, polycarbonate resins, acrylic resins, polyarylate resins, polyester resins, and polysulfone resins, as well as copolymers and and any combination thereof. Preferably, the plastic substrate is transparent.

On the exterior side of the plastic substrate is one or more protective layers including a weathering layer. The weathering layer provides high weatherablity and long term ultraviolet (UV) protection. Covering the weathering layer may be an abrasion layer. The abrasion layer provides a "glass-like" abrasion resistance.

An antenna trace may be located at numerous locations within the window assembly. Preferably, the antenna trace is made of a silver pigmented ink. However, the antenna trace may be made of any material suitable for the reception of wireless signals such as metallic pigmented inks, conductive films, or conductive polymers.

Further objects, features and advantages of this invention will become readily apparent to persons skilled in the art after a review of the following description, with reference to the drawings and claims that are appended to and form a part of this specification.

DETAILED DESCRIPTION

Figure 1:
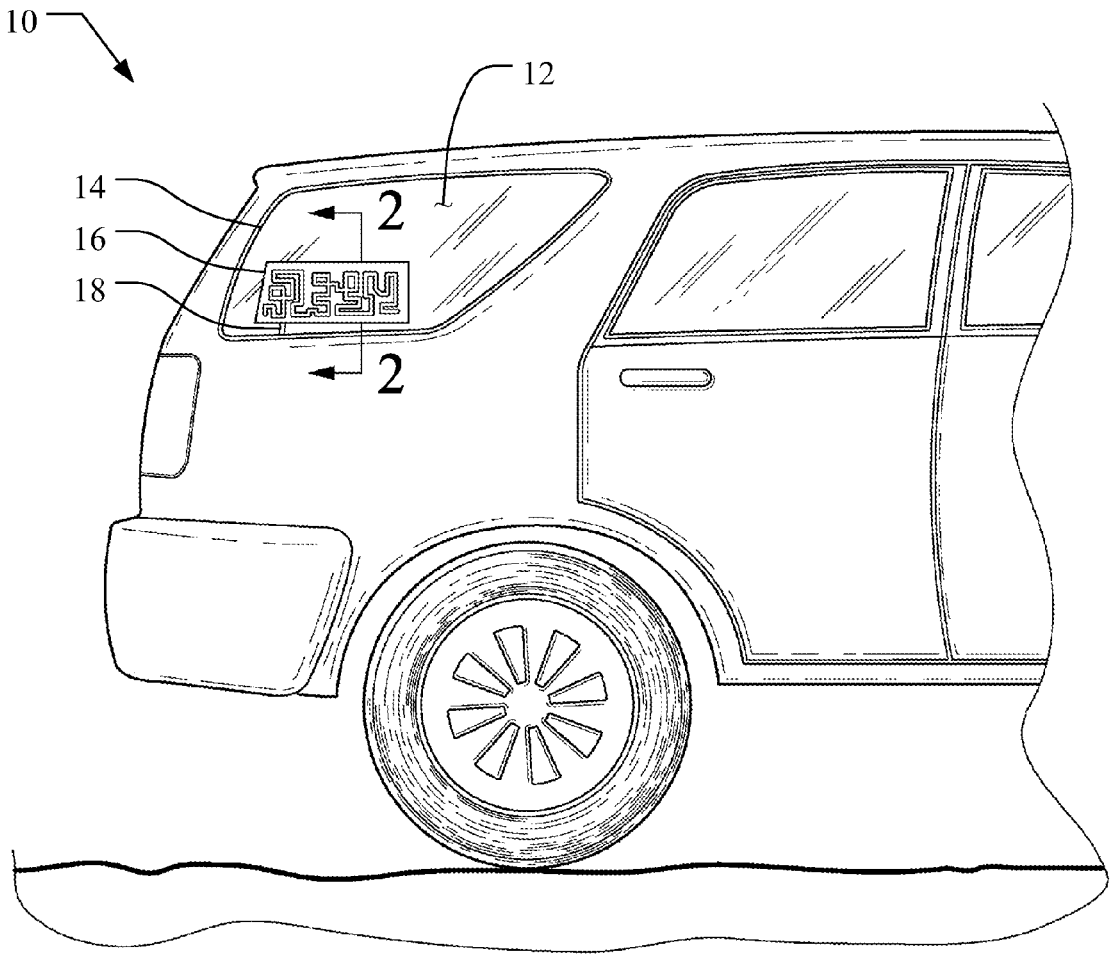
FIG. 1 is a perspective view of an automobile having a window panel assembly with an integrated antenna embodying the principles of the present invention.

Referring to FIG. 1, an automobile 10 incorporating the present invention is shown therein. The automobile 10 includes a window assembly 12 mounted via a frame 14 to the automobile 10. Embedded within the window assembly 12 is an antenna 16.

As stated previously, the window assembly 12 has the antenna 16 embedded within. The antenna 16 is capable of receiving any number of wireless signals including, but not limited to AM, FM, satellite radio (such as XM™ and Sirius™), GSM, CDMA, IEEE 802.11a, IEEE 802.11b, IEEE 802.11g, IEEE 802.11x, HomeRF™ and Bluetooth™. Generally, the antenna 16 is a fractal shaped antenna; however, any suitable shaped antenna may be used.

An interface 18 is connected to the antenna 16. The interface functions to connect a device capable of processing wireless signals, such as a radio receiver, to the antenna 16. For example, if a radio receiver (not shown) is connected to the interface 18, the radio receiver will be capable of receiving wireless signals, such as AM and FM, from the antenna 16 via the interface 18.

Although this description describes using the window assembly 14 as a side window of the automobile 10, the invention is equally applicable to other areas of the automobile 10. For example, the window assembly 14 may be appropriately located and dimensioned to be used as a moon/sun roof, driver side window, a passenger side window, rear windows, a front windshield and/or any other windows the automobile 10 may have.

Figure 2A:
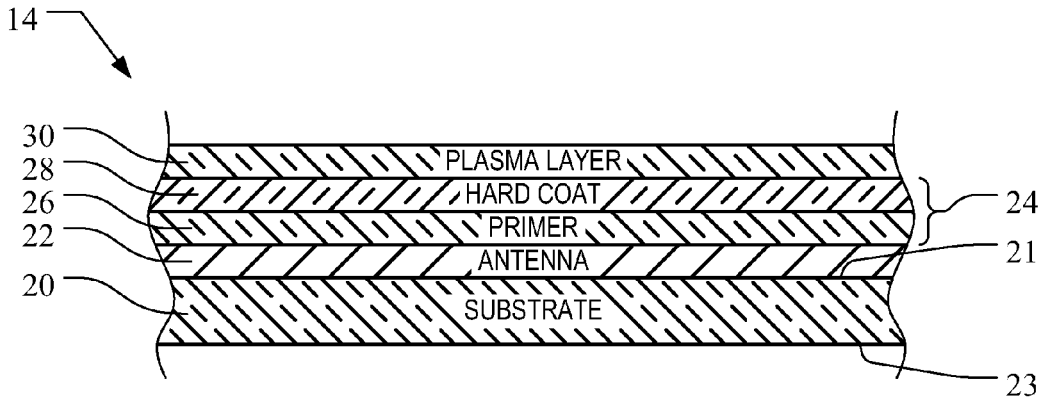
FIG. 2A is a cross sectional view of a portion of the window assembly generally taken along lines 2-2 in FIG. 1.

Referring to FIG. 2A, a cross section, generally taken along lines 2-2 in FIG. 1 is shown therein. The window assembly 14 includes a plastic substrate 20 having a top side 21 and a bottom side 23. The plastic substrate 20 may be made of a thermoplastic resin including, but not limited to, polycarbonate resins, acrylic resins, polyarylate resins, polyester resins, and polysulfone resins, as well as copolymers and any combination thereof. Preferably, the plastic substrate 20 is transparent.

Located above the top side 21 of the plastic substrate 20 an antenna trace 22. The antenna trace 22 is a cross section portion of the antenna 16 shown in FIG. 1. Preferably, the antenna trace 22 is made of a silver pigmented ink. However, the antenna trace 22 may be made of any material suitable for the reception of wireless signals. Other antenna materials could include metallic pigmented inks, conductive films, or conductive polymers. Several examples of metallic pigmented inks include those comprising pigments of copper, zinc, aluminum, magnesium, nickel, tin, or mixtures and alloys of the like. Conductive films may comprise but not be limited to indium tin oxide (ITO), indium doped zinc oxide (IZO), and aluminum doped zinc oxide. Examples of conductive polymers include but are not limited to polyaniline and polythiophene (i.e., Baytron® polymers, H. C. Starck GmbH, Germany). The antenna trace 22 is generally printed onto the plastic substrate 20 (or any other layer as will be described later) via a suitable printing method such as screen printing, inkjet printing, or dispensing. The dimensions of the antenna trace 22 are design specific and may vary. For example, the antenna trace 22 may be a fractal antenna which is generally more flat and ribbon like. However, the antenna trace 22 may be a dipole antenna which is thinner and more wire like. Different types and shapes of antennas are disclosed in U.S. Pat. No. 6,809,692, incorporated herein by reference.

Above the antenna trace 22 is a weathering layer 24. The weathering layer 24 may be constructed of two layers: a primer layer 26 and a hard-coat layer 28. One example of a primer layer 26 is an acrylic primer, such as SHP401 from General Electric Silicones of Wilton, Connecticut, or SHP9X from Exatec L.L.C. of Wixom, Mich. The hard-coat layer 28 is generally a silicone hard-coat such as AS4000 from General Electric Silicones or SHX from Exatec, L.L.C. However, other hard-coat compositions, such as polyurethanes, either applied on top of a primer layer or directly to the antenna and plastic substrate may be utilized.

The weathering layer 24 provides high weatherablity and long term UV protection. Further, the weathering layer 24 may also include a material having lonomer chemistry or similar material. Moreover, in another embodiment of the present invention silicon/nanoparticles may be blended into the material of the weathering layer 24 or a silioxane copolymer is formed into the weathering layer 24 by polymerization. The weathering layer may be applied by any technique known to those skilled in the art including but not limited to spray coating, flow coating, dip coating, spin coating, and curtain coating.

Covering the weathering layer 24 is an abrasion layer 30. The abrasion layer provides "glass-like" abrasion resistance to the window assembly 14. The plasma layer 30 may be a $SiO_xC_yH_z$ film deposited by plasma enhanced chemical vapor deposition (PECVD). The abrasion layer 30 may be a multi-layered system with each layer comprising a slightly different composition. The abrasion layer may be applied by any technique known to those skilled in the art including but not limited to plasma enhanced chemical vapor deposition, ion assisted plasma deposition, magnetron sputtering, electron beam evaporation, and ion beam sputtering.

Figure 2B:
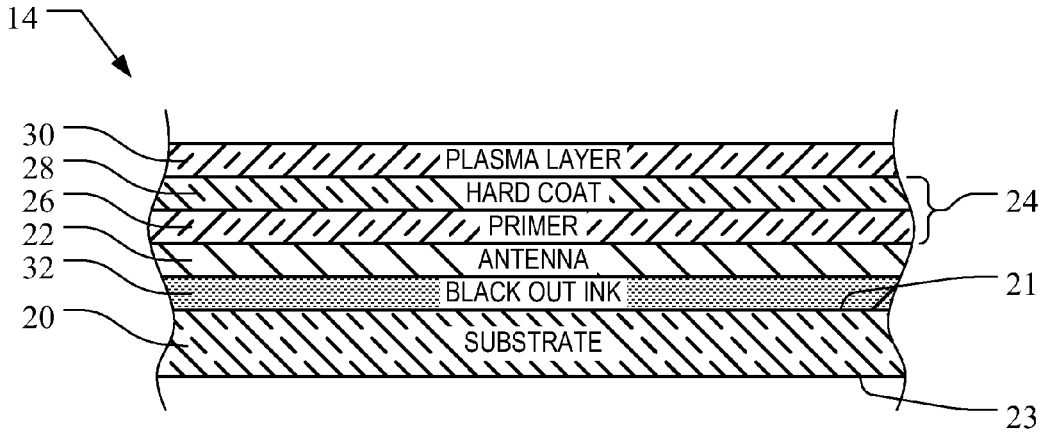
FIG. 2B is a cross sectional view similar to FIG. 2A of the window assembly having a black out ink layer.

Referring to FIG. 2B, an alternative embodiment of the window assembly 14 is shown. As will be true throughout this disclosure, similar reference numerals are utilized to refer to similar items. Here, a stylized ink layer 32 has been placed between the antenna trace 22 and the top side 21 of the plastic substrate 20. The stylized ink layer 32 functions to prevent and/or minimize the amount of light passing thought the window assembly 14. Furthermore, the stylized ink layer 32 may have the additional benefit of being able to be applied in such a way as to add to the aesthetic qualities of the window assembly 14.

Figure 2C:
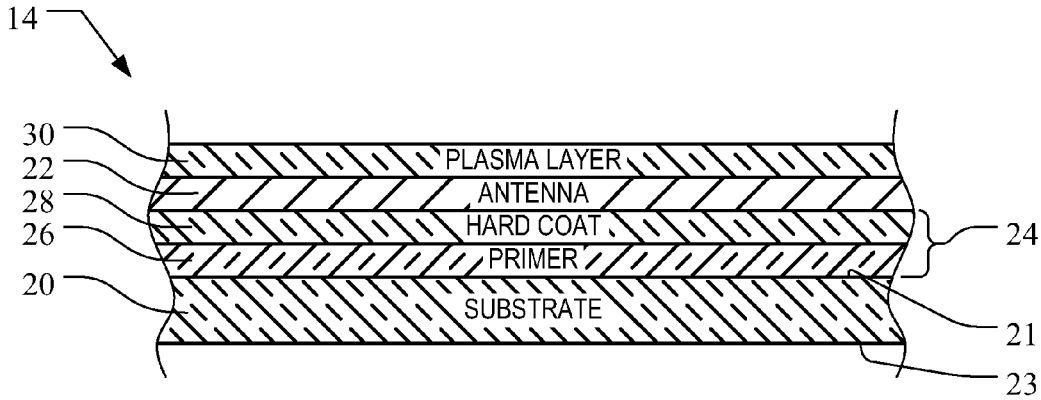
FIG. 2C is a cross sectional view similar to FIG. 2A of the window wherein the antenna trace is located between an abrasion layer and a weathering layer.
Figure 2D:
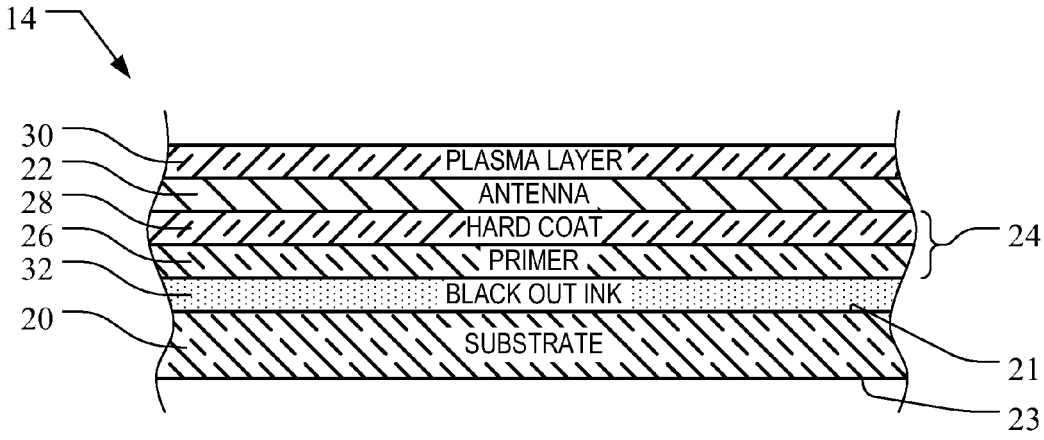
FIG. 2D is a cross sectional view similar to FIG. 2C of the window assembly having a black out ink layer.

Referring to FIGS. 2C and 2D, alternative embodiments of the window assembly 14 are shown. In these embodiments the antenna trace 22 has been placed between the weathering layer 24 and the abrasion layer 30. Furthermore, the weathering layer 24 is now directly applied to the top side 21 of the plastic substrate 20. The embodiment shown in FIG. 2D is similar with the only exception being that a layer of stylized ink is located between the weathering layer 24 and the top side 21 of the plastic substrate 20.

Figure 2E:
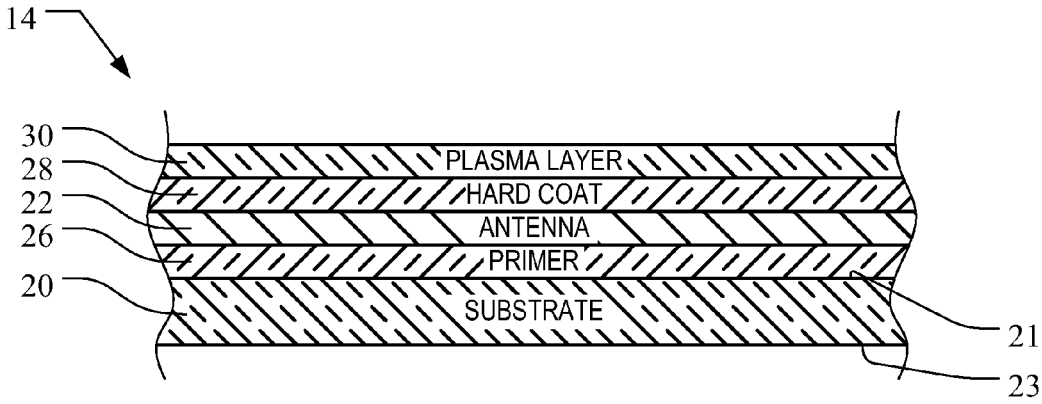
FIG. 2E is a cross sectional view similar to FIG. 2A of the window wherein the antenna trace is located between a primer layer and a hard-coat layer.
Figure 2F:
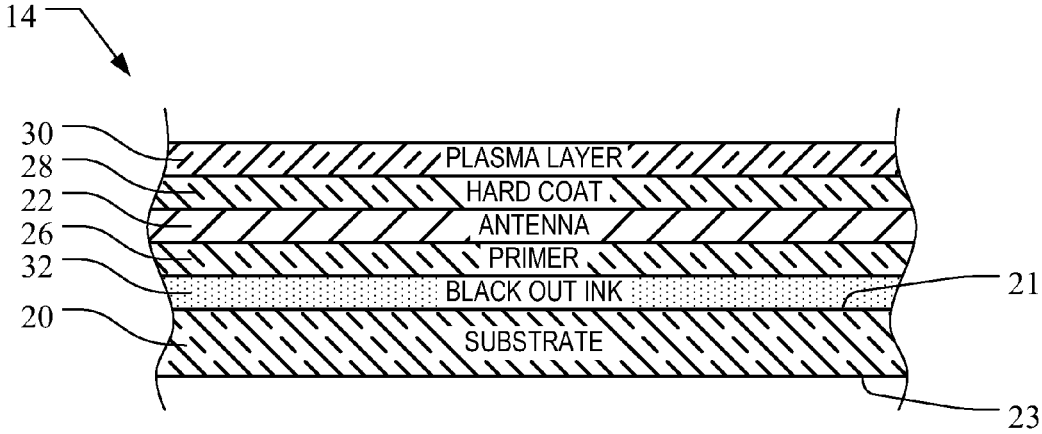
FIG. 2F is a cross sectional view similar to FIG. 2E of the window assembly having a black out ink layer.

Referring to FIGS. 2E and 2F, alternative embodiments of the window assembly 14 are shown. In these embodiments the antenna trace 22 has been placed between the primer layer 26 and the hard-coat layer 28. Furthermore, the primer layer 26 is now directly applied to the top side 21 of the plastic substrate 20. FIG. 2F is similar with the only exception being that a layer of stylized ink is located between the primer layer 26 and the top side 21 of the plastic substrate 20.

Figure 2G:
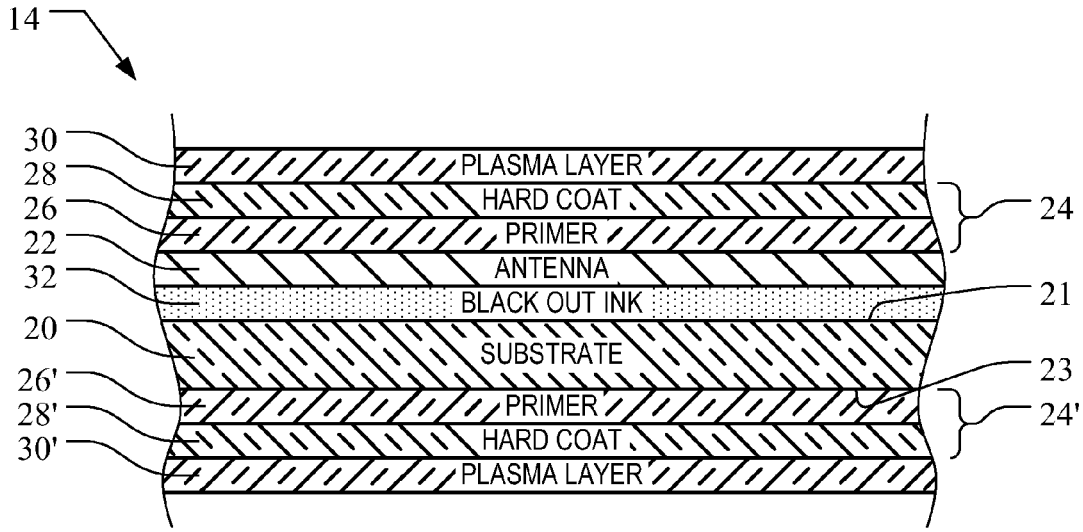
FIG. 2G is a cross sectional view similar to FIG. 2A of the window assembly having a weathering layer and an abrasion layer on both sides of a substrate.

Referring to FIG. 2G, another alternative embodiment of the window assembly 14 is shown. This embodiment is similar to the embodiment shown in FIG. 2A. The difference being that this embodiment has a second weathering layer 24' and a second abrasion layer 30' coupled to the bottom side 23 of the plastic substrate 20. Similar to the embodiment shown in FIG. 2A, the second weathering layer 24' is made of a primer layer 26' and a hard-coat layer 28'. It should be understood that the additional of the second weathering layer 24' and the second abrasion layer 30' coupled to the bottom side 23 of the plastic substrate 20 is equally applicable to all the embodiment described within this disclosure.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

The invention claimed is:

1. A window assembly capable of receiving wireless signals, the window assembly comprising:

a transparent plastic substrate forming a window panel and having a first side and a second side;

a first coating coupled to and extending substantially over the entirety of the first side of the plastic substrate, the first coating comprising a weathering layer and an abrasion layer, the weathering layer located between the abrasion layer and the first side of the plastic substrate; and an antenna located adjacent to the first side of the plastic substrate between the plastic substrate and the first coating.

2. The assembly of claim 1, wherein the plastic substrate is made from at least one of the polycarbonate, acrylic, polyarylate, polyester, polysulfone, and combinations thereof.

3. The assembly of claim 1, wherein the antenna is made from at least one of a metallic pigmented ink, a conductive film, or a conductive polymer.

4. The assembly of claim 3 wherein the metallic pigmented ink comprises metallic pigments selected from one of silver, copper, zinc, aluminum, magnesium, nickel, tin, and alloys thereof.

5. The assembly of claim 3 wherein the metallic pigmented ink comprises a silver pigmented ink.

6. The assembly of claim 3 wherein the conductive film comprises one selected from indium tin oxide (ITO), indium doped zinc oxide (IZO), and aluminum doped zinc oxide.

7. The assembly of claim 3 wherein the conductive polymer is one selected from polyaniline and polythiophene.

8. The assembly of claim 1, wherein the antenna is a fractal shaped antenna.

9. The assembly of claim 1, wherein the antenna is located between the weathering layer and the first side of the plastic substrate.

10. The assembly of claim 1, wherein the antenna is located between the weathering layer and the abrasion layer.

11. The assembly of claim 1, wherein the abrasion layer is a $SiO_xC_yH_z$ film.

12. The assembly of claim 1, wherein the plastic substrate is transparent.

13. A window assembly capable of receiving wireless signals, the window assembly comprising:

a plastic substrate having a first side and a second side;

a first coating coupled to the first side of the plastic substrate wherein the first coating comprises a weathering layer and an abrasion layer, the weathering layer located between the abrasion layer and the first side of the plastic substrate, the weathering layer further comprising a primer layer and a hard-coat layer, the primer layer being coupled to the first side of the plastic substrate and the hard-coat layer being coupled to the primer layer, thereby situating the hard-coat layer between the primer layer and the abrasion layer; and an antenna located adjacent to the first side of the plastic substrate.

14. The assembly of claim 13, wherein the antenna is located between the primer layer and the hard-coat layer.

15. The assembly of claim 13, wherein the primer is an acrylic primer.

16. The assembly of claim 13, wherein the hard-coat is silicon based hard-coat.

17. A window assembly capable of receiving wireless signals, the window assembly comprising:

a plastic substrate having a first side and a second side;

a first coating coupled to the first side of the plastic substrate;

a decorative ink layer located between the first side of the plastic substrate and the coating; and an antenna located adjacent to the first side of the plastic substrate.

18. A window assembly capable of receiving wireless signals, the window assembly comprising:

a transparent plastic substrate forming a window panel and having a first side and a second side;

a first coating coupled to and extending substantially over the entirety of the first side of the plastic substrate;

an antenna located adjacent to the first side of the plastic substrate between the plastic substrate and the first coating; and a second coating layer coupled to the second side of the plastic substrate.

19. The assembly of claim 18, wherein the second coating layer comprises a weathering layer and an abrasion layer, the weathering layer located between the abrasion layer and the second side of the plastic substrate.

20. The assembly of claim 19, wherein the abrasion layer is a $SiO_xC_yH_z$ film.

21. A window assembly capable of receiving wireless signals, the window assembly comprising: a plastic substrate having a first side and a second side;

a first coating coupled to the first side of the plastic substrate;

an antenna located adjacent to the first side of the plastic substrate;

a second coating layer coupled to the second side of the plastic substrate, the second coating layer comprising a weathering layer and an abrasion layer, the weathering layer located between the abrasion layer and the second side of the plastic substrate, the weathering layer further comprising a primer layer and a hard-coat layer.

22. The assembly of claim 21, wherein the primer is an acrylic primer.

23. The assembly of claim 21, wherein the hard-coat is silicon based hard-coat.

* * * * *